US009915182B2

(12) United States Patent
Son et al.

(10) Patent No.: US 9,915,182 B2
(45) **Date of Patent: *Mar. 13, 2018**

(54) CONTINUOUS VARIABLE VALVE DURATION APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 137 days.

This patent is subject to a terminal disclaimer.

(21) Appl. No.: 14/948,275

(22) Filed: Nov. 21, 2015

(65) Prior Publication Data

US 2016/0160706 A1 Jun. 9, 2016

(30) Foreign Application Priority Data

Dec. 9, 2014 (KR) ..... 10-2014-0175838

(51) Int. Cl.
*F01L 1/34* (2006.01)
*F01L 13/00* (2006.01)

(52) U.S. Cl.
CPC ... *F01L 13/0015* (2013.01); *F01L 2013/0084* (2013.01)

(58) Field of Classification Search
CPC ..... F01L 13/0015; F01L 2013/0084
See application file for complete search history.

(56) References Cited

U.S. PATENT DOCUMENTS

| | | | | |
|---|---|---|---|---|
| 5,924,334 | A | 7/1999 | Hara et al. | |
| 7,721,691 | B2 | 5/2010 | Tateno | |
| 2013/0146006 | A1* | 6/2013 | Kim | F01L 1/0532 123/90.17 |

FOREIGN PATENT DOCUMENTS

| | | | |
|---|---|---|---|
| EP | 2 322 771 | A1 | 5/2011 |
| JP | 2009-236010 | A | 10/2009 |
| KR | 10-2013-0063819 | A | 6/2013 |
| KR | 10-1326818 | B1 | 11/2013 |

* cited by examiner

*Primary Examiner* — Zelalem Eshete
(74) *Attorney, Agent, or Firm* — Morgan, Lewis & Bockius LLP

(57) ABSTRACT

A continuous variable valve duration apparatus may include a camshaft, a first cam portion and a second cam portion of which a cam is formed thereto respectively, of which the camshaft is inserted thereto, of which relative phase angles with respect to the camshaft are variable, and the first and second cam portions disposed on one cylinder and the next cylinder respectively, a first inner bracket and a second inner bracket transmitting rotation of the camshaft to the first and second cam portions respectively, a slider housing of which the first and second inner brackets are rotatably inserted thereto and of which relative position with respect to the camshaft is variable and a control portion selectively changing the relative position of the slider housing.

19 Claims, 8 Drawing Sheets

CONTINUOUS VARIABLE VALVE DURATION APPARATUS AND ENGINE PROVIDED WITH THE SAME

CROSS-REFERENCE TO RELATED APPLICATION

The present application claims priority to and the benefit of Korean Patent Application No. 10-2014-0175838 filed on Dec. 9, 2014, the entire contents of which is incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve duration apparatus and an engine provided with the same which may vary opening duration of a valve according to operation conditions of an engine, with a simple construction.

According to various aspects of the present invention, a continuous variable valve duration apparatus may include a camshaft, a first and a second cam portions of which a cam is formed thereto respectively, of which the camshaft is inserted thereto, of which relative phase angles with respect to the camshaft are variable, and the first and second cam portions disposed on one cylinder and the next cylinder respectively, a first and a second inner brackets transmitting rotation of the camshaft to the first and second cam portions respectively, a slider housing of which the first and second inner brackets are rotatably inserted thereto and of which relative position with respect to the camshaft is variable and a control portion selectively changing the relative position of the slider housing.

A first and a second sliding holes may be formed to the first and second inner brackets respectively, a slider pin connected with the camshaft may be rotatably inserted into the first sliding hole, a cam key may be formed to the first and second cam portions respectively and a cam pin of which a cam key slot for the cam key to be slidably inserted thereto may be formed thereto is slidably inserted into the second sliding hole.

The slider pin may include a pin body connected to the camshaft and a pin head slidably connected with the pin body and rotatably inserted into the first sliding hole.

The continuous variable valve duration apparatus may further include a double row bearing disposed within the slider housing and connected with the first and second inner brackets.

A control slot may be formed to the slider housing, and the control portion may include an eccentric control shaft inserted into the control slot and a control motor selectively rotating the eccentric control shaft in order to change the relative position of the sliding housing.

According to various aspects of the present invention, a continuous variable valve duration apparatus may include a camshaft, a first, a second, a third and a fourth cam portions of which a cam is formed thereto respectively, of which the camshaft is inserted thereto, of which relative phase angles with respect to the camshaft are variable, and the first, the second, the third and the fourth cam portions disposed on cylinders sequentially, a first, a second, a third and a fourth inner brackets transmitting rotation of the camshaft to the first, the second, the third and the fourth cam portions respectively, a first slider housing of which the first and second inner brackets are rotatably inserted thereto and of which relative position with respect to the camshaft is variable, a second slider housing of which the third and the fourth inner brackets are rotatably inserted thereto and of which relative position with respect to the camshaft is variable and a control portion selectively changing the relative positions of the first and the second slider housings.

A first and a second sliding holes may be formed to the first, the second, the third and the fourth inner brackets respectively, a slider pin connected with the camshaft may be rotatably inserted into the first sliding hole, a cam key may be formed to the first, the second, the third and the fourth cam portions respectively and a cam pin of which a cam key slot for the cam key to be slidably inserted thereto may be formed thereto is slidably inserted into the second sliding hole.

The slider pin may include a pin body connected to the camshaft and a pin head slidably connected with the pin body and rotatably inserted into the first sliding hole.

The continuous variable valve duration apparatus may further include a double row bearing disposed within the first and the second slider housings respectively and connected with the first, the second, the third and the fourth inner brackets.

A control slot may be formed to the first and second slider housings respectively, and the control portion may include an eccentric control shaft inserted into the control slots and a control motor selectively rotating the eccentric control shaft in order to change the relative position of the sliding housing.

The control portion may further include a worm wheel connected to the eccentric control shaft and a worm gear connected to the control motor and engaged with the worm wheel.

The camshaft may be mounted by cam caps, guide rods may be connected to the cam cap respectively, the first and second slider housings may be connected through a support bracket, guide holes where the guide rod is inserted thereto respectively may be formed to the support bracket and the support bracket may be guided along the guide rods.

A shaft hole where the eccentric control shaft is inserted thereto may be formed to the each cam cap.

According to various aspects of the present invention, an engine may include a camshaft, a first, a second, a third and a fourth cam portions of which a cam is formed thereto respectively, of which the camshaft is inserted thereto, of which relative phase angles with respect to the camshaft are variable, disposed on cylinders sequentially and the first, the second, the third and the fourth cam portions mounted to a cylinder head by cam caps, a first, a second, a third and a fourth inner brackets transmitting rotation of the camshaft to the first, the second, the third and the fourth cam portions respectively, a first slider housing of which the first and second inner brackets are rotatably inserted thereto and of which relative position with respect to the camshaft is variable, a second slider housing of which the third and the fourth inner brackets are rotatably inserted thereto and of which relative position with respect to the camshaft is variable and a support bracket connecting the first and second slider housings and a control portion selectively changing the relative positions of the first and the second slider housings.

A first and a second sliding holes may be formed to the first, the second, the third and the fourth inner brackets respectively, a slider pin connected with the camshaft may be rotatably inserted into the first sliding hole, a cam key may be formed to the first, the second, the third and the fourth cam portions respectively and a cam pin of which a cam key slot for the cam key to be slidably inserted thereto may be formed thereto is slidably inserted into the second sliding hole.

The slider pin may include a pin body connected to the camshaft and a pin head slidably connected with the pin body and rotatably inserted into the first sliding hole.

The engine may further include a double row bearing disposed within the first and the second slider housings respectively and connected with the first, the second, the third and the fourth inner brackets.

A control slot may be formed to the first and second slider housings respectively, and the control portion may include an eccentric control shaft inserted into the control slots, a worm wheel connected to the eccentric control shaft, a worm gear connected to the control motor and engaged with the worm wheel and a control motor selectively driving the worm gear.

Guide rods may be connected to the cam cap respectively, guide holes where the guide rod is inserted thereto respectively may be formed to the support bracket and the support bracket may be guided along the guide rods.

A shaft hole where the eccentric control shaft is inserted thereto may be formed to the each cam cap.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
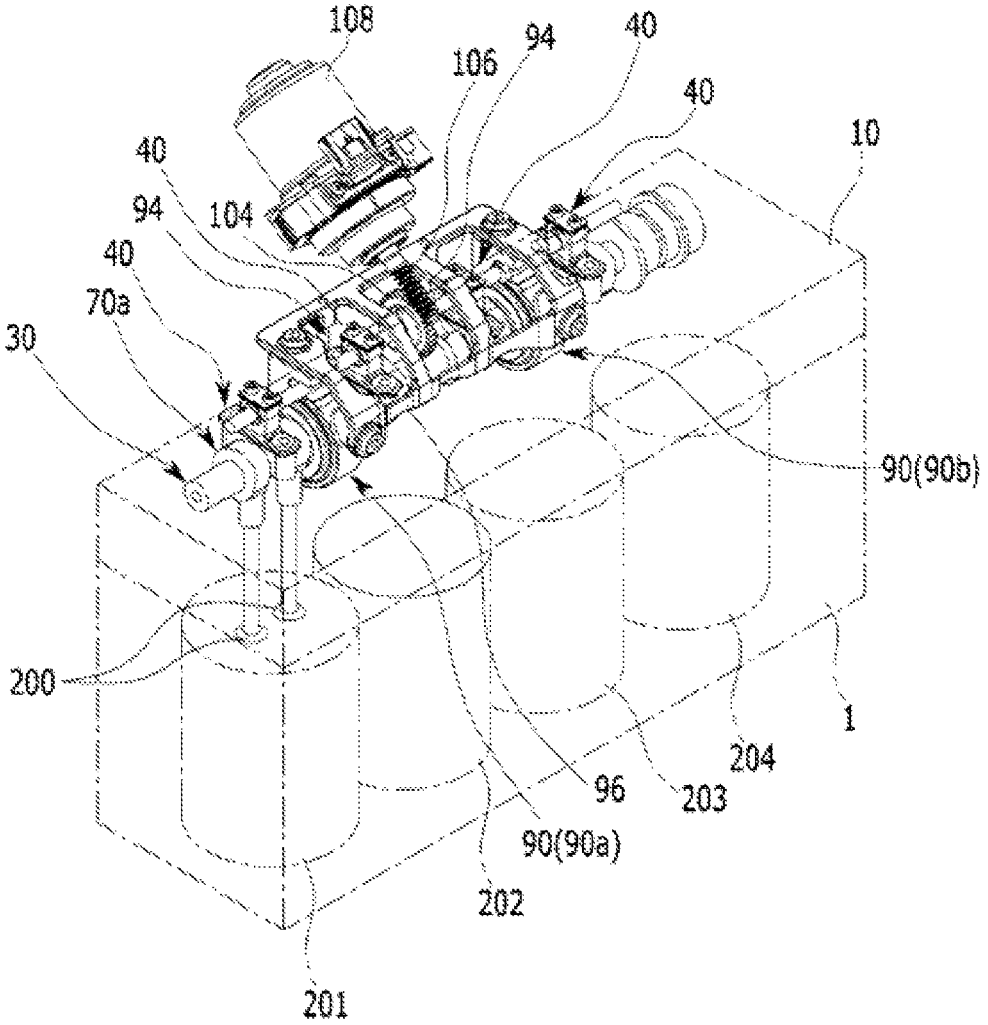
FIG. 1 is a perspective view of an engine provided with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
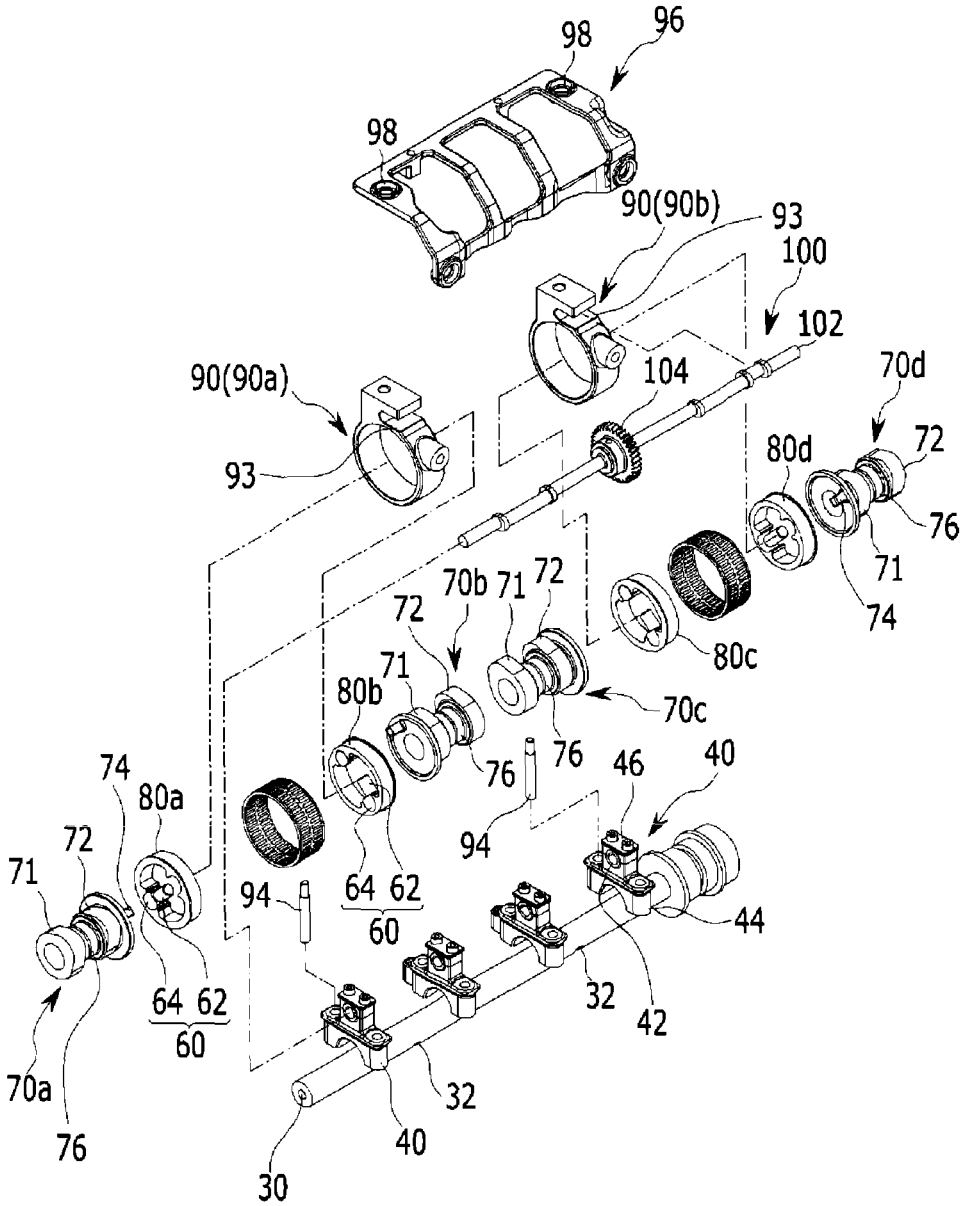
FIG. 2 is an exploded perspective view of a continuous variable valve duration apparatus according to an exemplary embodiment of the present invention.

FIG. 1 is a perspective view of an engine provided with a continuous variable valve duration apparatus according to an exemplary embodiment of the present invention and FIG. 2 is an exploded perspective view of a continuous variable valve duration apparatus according to an exemplary embodiment of the present invention.

Figure 3:
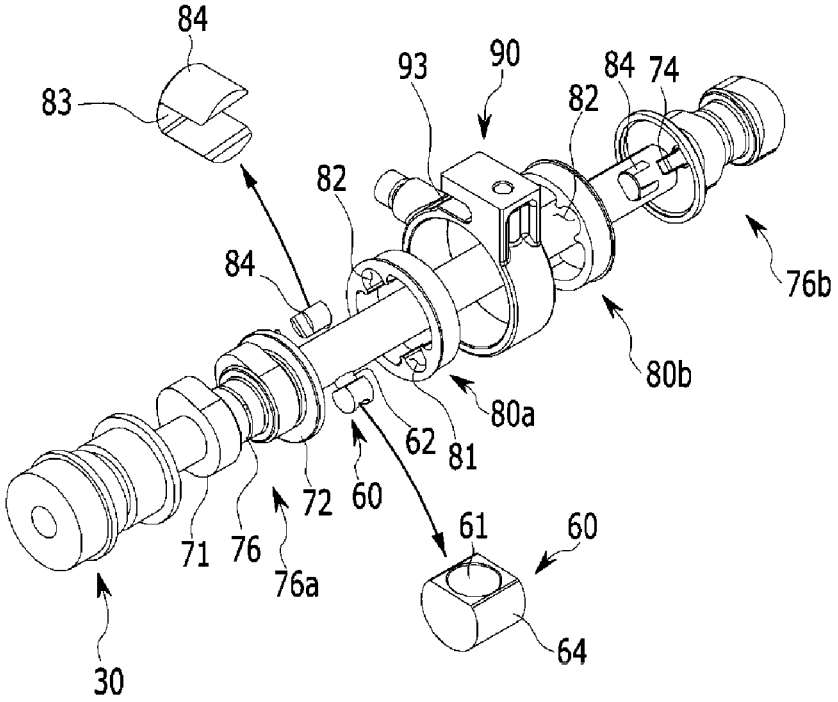
FIG. 3 is a partial exploded perspective view of a continuous variable valve duration apparatus according to an exemplary embodiment of the present invention.
Figure 4:
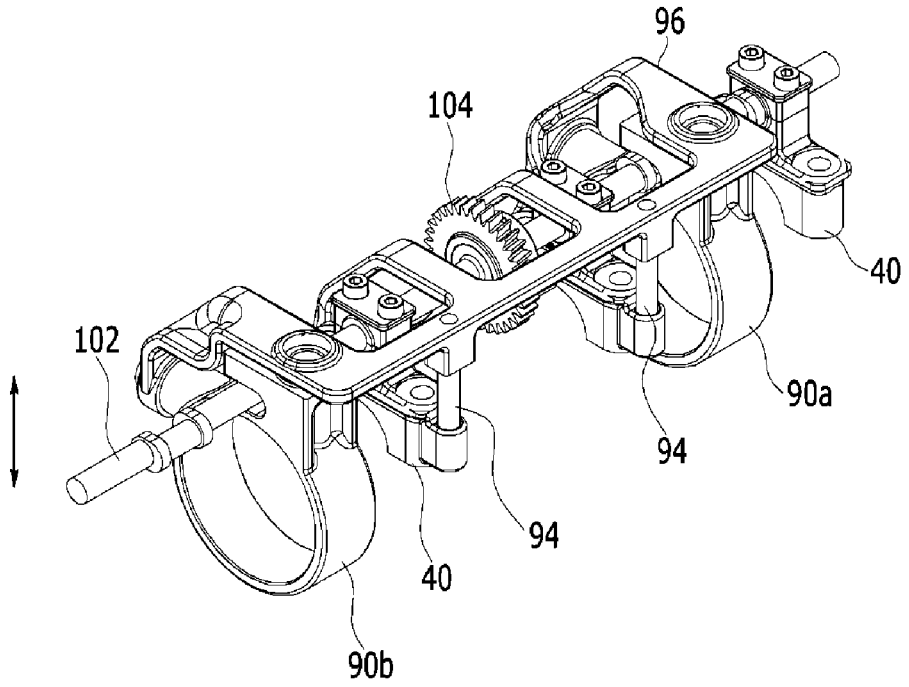
FIG. 4 is a partial perspective view of an engine provided with a continuous variable valve duration apparatus according to an exemplary embodiment of the present invention.

FIG. 3 is a partial exploded perspective view of a continuous variable valve duration apparatus according to an exemplary embodiment of the present invention and FIG. 4 is a partial perspective view of an engine provided with a continuous variable valve duration apparatus according to an exemplary embodiment of the present invention.

Referring to FIG. 1 to FIG. 4, an engine according to an exemplary embodiment of the present invention includes an engine block 1, and a cylinder head 10 disposed on the engine block 1 and a continuous variable valve duration apparatus mounted to the cylinder head 10.

In the drawings, the engine includes 4 cylinders 201, 202, 203 and 204, but is not limited thereto.

The continuous variable valve duration apparatus includes a camshaft 30, a first and a second cam portions 70*a* and 70*b* of which a cam 71 or 72 is formed thereto respectively, of which the camshaft 30 is inserted thereto, of which relative phase angles with respect to the camshaft 30 are variable, and the first and second cam portions 70*a* and 70*b* disposed on one cylinder and the next cylinder respectively, a first and a second inner brackets 80*a* and 80*b* transmitting rotation of the camshaft 30 to the first and second cam portions 70*a* and 70*b* respectively, a slider housing 90 of which the first and second inner brackets 80*a* and 80*b* are rotatably inserted thereto and of which relative position with respect to the camshaft 30 is variable and a control portion 100 selectively changing the relative position of the slider housing 90.

The camshaft 30 may be an intake camshaft or an exhaust camshaft.

The cam 71 and 72 is formed as a pair and a cam cap engaging portion 76 is formed between the cams 71 and 72 for engaged with the cam cap 40. Thus the cam portion 70 is stably supported by the cam cap 40.

The cams 71 and/or 72 contacts to open valve 200.

A first and a second sliding holes 81 and 82 are formed to the first and second inner brackets 80*a* and 80*b* respectively, a slider pin 60 connected with the camshaft 30 is rotatably inserted into the first sliding hole 81, a cam key 74 is formed to the first and second cam portions 70*a* and 70*b* respectively and a cam pin 84 of which a cam key slot 83 for the cam key 74 to be slidably inserted thereto is formed thereto is slidably inserted into the second sliding hole 82.

The slider pin 60 includes a pin body 62 connected to the camshaft 30 and a pin head 64 slidably connected with the pin body 62 and rotatably inserted into the first sliding hole 81. A slider pin hole 61 is formed to the pin head 64 and the pin body 62 is slidably inserted into the slider pin hole 61.

A double row bearing 92 is disposed within the slider housing 90 and is connected with the first and second inner brackets 80*a* and 80*b*. Thus, the first and second inner bracket 80*a* and 80*b* are disposed within one slider housing 90 and may be rotated without interruption due to the double row bearing 92.

Also, since the first and second inner brackets 80*a* and 80*b* are disposed within one slider housing 90, thus numbers of elements may be reduce, productivity may be improved and space for accommodating the continuous variable valve duration apparatus may be reduced.

A control slot 93 is formed to the slider housing 90, and the control portion 100 includes an eccentric control shaft 102 inserted into the control slot, and a control motor 108 selectively rotating the eccentric control shaft 102 in order to change the relative position of the sliding housing 90. A worm wheel 104 is connected to the eccentric control shaft 102 and a worm gear 106 is connected to the control motor 108 and engaged with the worm wheel 104.

Each cam cap 40 includes a cam cap body 44 and a cam cap cover 46 connected with the cam cap body 44, and a shaft hole 42 for the eccentric control shaft 102 to be inserted thereto is formed between the cam cap body 44 and the cam cap cover 46. Since the eccentric control shaft 102 is inserted into the shaft hole 42, the eccentric control shaft 102 may be stably supported.

As shown in FIG. 1 to FIG. 4, the continuous variable valve duration apparatus according to various exemplary embodiments of the present invention may be applied to an engine with four cylinders, but is not limited thereto. The continuous variable valve duration apparatus according to various exemplary embodiments of the present invention may be applied to an engine with various cylinders, for example with six or more cylinders.

For easy comprehension, the continuous variable valve duration apparatus which is applied to a four-cylinder engine will be discussed.

A continuous variable valve duration apparatus includes a camshaft 30, a first, a second, a third and a fourth cam portions 70*a*, 70*b*, 70*c* and 70*d* of which a cam 71 and/or 72 is formed thereto respectively, of which the camshaft 30 is inserted thereto, of which relative phase angles with respect to the camshaft 30 are variable, and the first, the second, the third and the fourth cam portions 70*a*, 70*b*, 70*c* and 70*d* disposed on cylinders sequentially, a first, a second, a third and a fourth inner brackets 80*a*, 80*b*, 80*c* and 80*d* transmitting rotation of the camshaft 30 to the first, the second, the third and the fourth cam portions 70*a*, 70*b*, 70*c* and 70*d* respectively, a first slider housing 90*a* of which the first and second inner brackets 80*a* and 80*b* are rotatably inserted thereto and of which relative position with respect to the camshaft 30 is variable, a second slider housing 90*b* of which the third and the fourth inner brackets 80*c* and 80*d* are rotatably inserted thereto and of which relative position with respect to the camshaft 30 is variable and a control portion 100 selectively changing the relative positions of the first and the second slider housings 90*a* and 90*b*.

The camshaft 30 is mounted to the cam caps 40, guide rods 94 are connected to the cam caps 40 respectively, the first and second slider housing 90*a* and 90*b* are connected by a support bracket 96, guide holes 89 where the guide rod 94 is inserted thereto respectively are formed to the support bracket 96, and the support bracket 96 may be guided along the guide rods 94.

Since the structure and functions of the inner brackets 80*a*, 80*b*, 80*c* and 80*d*, the slider housings 90*a* and 90*b*, the double row bearing 92 are the same as described above, thus repeated explanation will be omitted.

Figure 5:
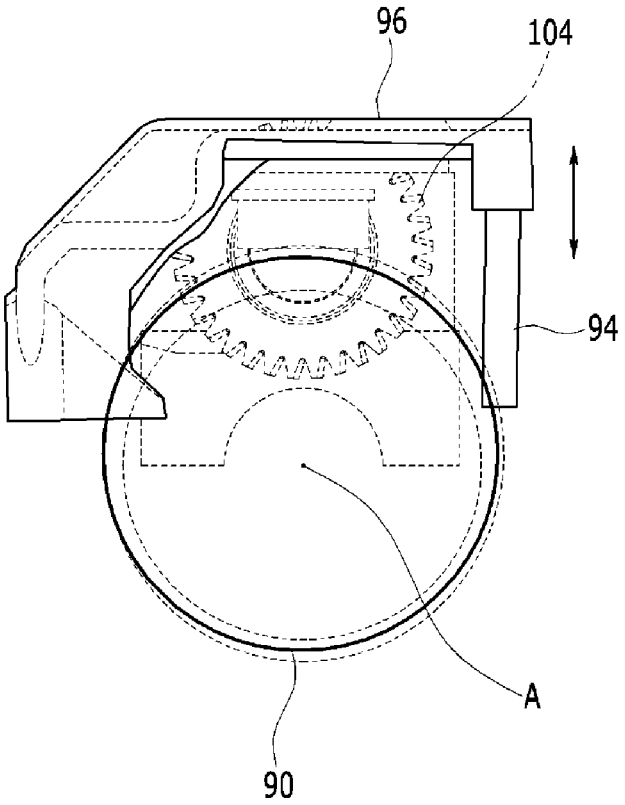
FIG. 5 is a drawing showing operation of a continuous variable valve duration apparatus according to an exemplary embodiment of the present invention.
Figure 6:
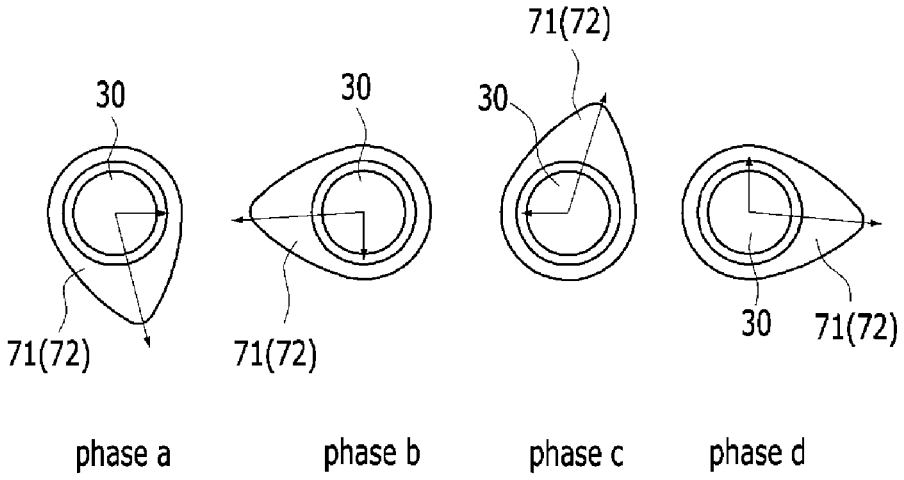
FIG. 6 and FIG. 7 are drawings showing mechanical motions of cams of a continuous variable valve duration apparatus according to an exemplary embodiment of the present invention.
Figure 7:
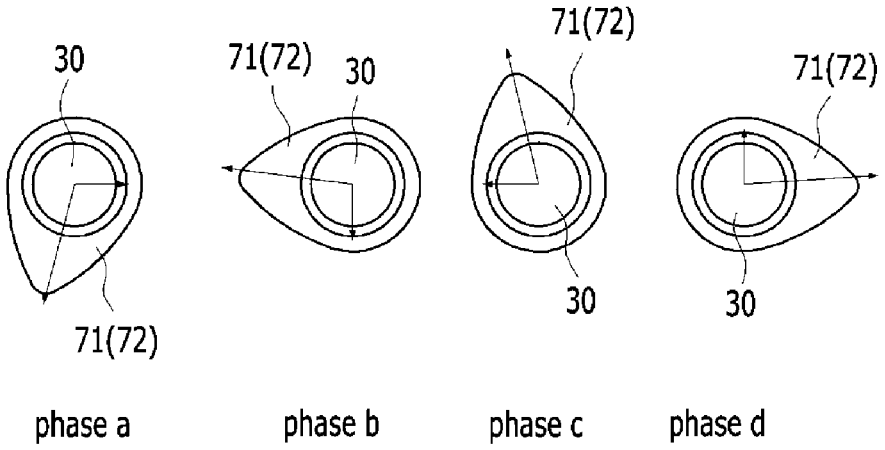

FIG. 5 is a drawing showing operation of a continuous variable valve duration apparatus according to an exemplary embodiment of the present invention, and FIG. 6 and FIG. 7 are drawings showing mechanical motions of cams of a continuous variable valve duration apparatus according to an exemplary embodiment of the present invention.

Referring to FIG. 1 to FIG. 7, operations of the continuous variable valve duration apparatus according to various exemplary embodiments of the present invention will be described.

According to engine operation states, an ECU (engine controller or electric controller) transmits control signals to the motor 108 of the control portion 100 to change the relative position of the slider housing 90.

For example, as shown in FIG. 5 when the motor 108 rotates the eccentric control shaft 102 for the slider housing 90 to be moved, the rotation center of the inner bracket 80 moves with respect to the rotation center of the camshaft 30. Thus, angular acceleration of the cam portion 70 is changed so as that duration of the valve is changed.

As shown in FIG. 6, while the phase angle of the camshaft 30 is constantly changed when the relative rotation center of the cams 71 and 72 with respect to the rotation center of the camshaft 30 is changed downward, the rotation speed of the cams 71 and 72 is relatively faster than rotation speed of the camshaft 30 from phase a to phase b and from phase b to phase c, then the rotation speed of the cams 71 and 72 is relatively slower than rotation speed of the camshaft 30 from phase c to phase d and from phase d to phase a. That is, the valve duration is changed.

As shown in FIG. 7, while the phase angle of the camshaft 30 is constantly changed when the relative rotation center of the cams 71 and 72 with respect to the rotation center of the camshaft 30 is changed upward, the rotation speed of the cams 71 and 72 is relatively slower than rotation speed of the camshaft 30 from phase a to phase b and from phase b to phase c, then the rotation speed of the cams 71 and 72 is relatively faster than rotation speed of the camshaft 30 from phase c to phase d and from phase d to phase a. That is, the valve duration is changed.

While the slider pin 60 is rotated together with the camshaft 30, the pin body 62 is slidable with respect to the pin head 64, the pin head 64 is rotatably inserted into the first sliding hole 81, the cam pin 84 is rotatably inserted into the second sliding hole 82, and the cam key 74 is slidable within the cam key slot 83. Thus, when the relative rotation centers of the inner bracket 80 and the camshaft 30 are changed, the relative rotation speed of the cams 71 and 72 with respect to the rotation speed of the camshaft 30 is changed.

Figure 8:
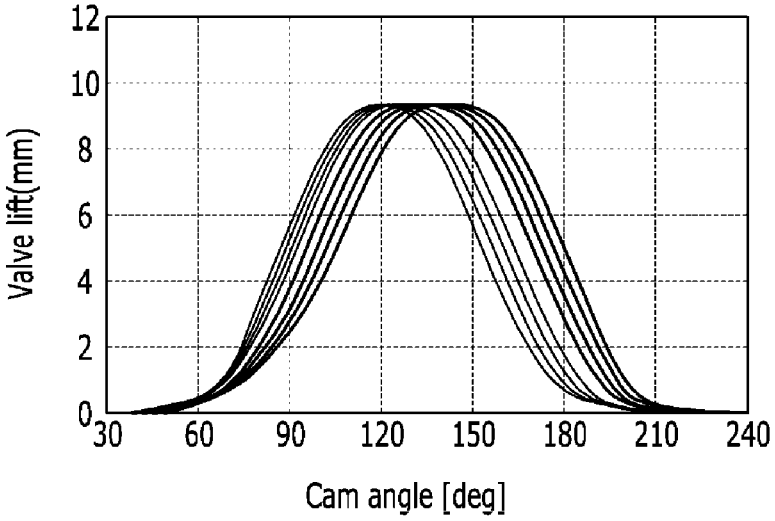
FIG. 8 is a graph of a valve profile of a continuous variable valve duration apparatus according to an exemplary embodiment of the present invention.

That is, as shown in FIG. 8, although maximum lift of the valve 200 is constant, however rotation speed of the cam 71 and 72 with respect to the rotation speed of the camshaft 30 is changed according to relative positions of the slider housing 90 so that closing and opening time of the valve 200 is changed. That is, duration of the valve 200 is changed.

While opening time of the valve 200 is constant, closing time of the valve 200 is changed in FIG. 8, it is not limited thereto. According to various mounting angle of the cams 71 and 72 and the valve 200, various contacting angles between cam lobe of the cams 71 and 72 and the valve 200 and so on, various valve duration may be performed.

Determinations of the control signals of the ECU according to the engine operation state is obvious to a person skilled in the art, thus detailed description will be omitted. As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus comprising:

a camshaft;

a first cam portion and a second cam portion of which a cam is formed thereto respectively, of which the camshaft is inserted thereto, of which relative phase angles with respect to the camshaft are variable, and the first and second cam portions disposed on one cylinder and the next cylinder respectively;

a first inner bracket and a second inner bracket transmitting rotation of the camshaft to the first and second cam portions respectively;

a slider housing of which the first and second inner brackets are rotatably inserted thereto and of which relative position with respect to the camshaft is variable; and a control portion selectively changing the relative position of the slider housing, wherein a first sliding hole and a second sliding hole are formed to the first and second inner brackets respectively;

wherein a slider pin connected with the camshaft is rotatably inserted into the first sliding hole;

wherein a cam key is formed to the first and second cam portions respectively; and wherein a cam pin of which a cam key slot for the cam key to be slidably inserted thereto is formed thereto is slidably inserted into the second sliding hole.

2. The continuous variable valve duration apparatus of claim 1, wherein the slider pin comprises:

a pin body connected to the camshaft; and a pin head slidably connected with the pin body and rotatably inserted into the first sliding hole.

3. The continuous variable valve duration apparatus of claim 1, further comprising a double row bearing disposed within the slider housing and connected with the first and second inner brackets.

4. The continuous variable valve duration apparatus of claim 1, wherein a control slot is formed to the slider housing, and the control portion comprises:

an eccentric control shaft inserted into the control slot; and a control motor selectively rotating the eccentric control shaft to change the relative position of the sliding housing.

5. A continuous variable valve duration apparatus a camshaft;

a first cam portion, a second cam portion, a third cam portion and a fourth cam portion of which a cam is formed thereto respectively, of which the camshaft is inserted thereto, of which relative phase angles with respect to the camshaft are variable, and the first, the second, the third and the fourth cam portions disposed on cylinders sequentially;

a first inner bracket, a second inner bracket, a third inner bracket, and a fourth inner bracket transmitting rotation of the camshaft to the first, the second, the third and the fourth cam portions respectively;

a first slider housing of which the first and second inner brackets are rotatably inserted thereto and of which relative position with respect to the camshaft is variable;

a second slider housing of which the third and the fourth inner brackets are rotatably inserted thereto and of which relative position with respect to the camshaft is variable; and a control portion selectively changing the relative positions of the first and the second slider housings.

6. The continuous variable valve duration apparatus of claim 5, wherein a first sliding hole and a second sliding hole are formed to the first, the second, the third and the fourth inner brackets respectively;

a slider pin connected with the camshaft is rotatably inserted into the first sliding hole;

a cam key is formed to the first, the second, the third and the fourth cam portions respectively; and a cam pin of which a cam key slot for the cam key to be slidably inserted thereto is formed thereto is slidably inserted into the second sliding hole.

7. The continuous variable valve duration apparatus of claim 6, wherein the slider pin comprises:

a pin body connected to the camshaft; and a pin head slidably connected with the pin body and rotatably inserted into the first sliding hole.

8. The continuous variable valve duration apparatus of claim 6, further comprising a double row bearing disposed within the first and the second slider housings respectively and connected with the first, the second, the third and the fourth inner brackets.

9. The continuous variable valve duration apparatus of claim 6, wherein a control slot is formed to the first and second slider housings respectively, and the control portion comprises:

an eccentric control shaft inserted into the control slots; and a control motor selectively rotating the eccentric control shaft to change the relative position of the sliding housing.

10. The continuous variable valve duration apparatus of claim 9, wherein the control portion further comprises:

a worm wheel connected to the eccentric control shaft; and a worm gear connected to the control motor and engaged with the worm wheel.

11. The continuous variable valve duration apparatus of claim 9, wherein the camshaft is mounted by cam caps;

guide rods are connected to the cam cap respectively;

the first and second slider housings are connected through a support bracket;

guide holes where the guide rod is inserted thereto respectively are formed to the support bracket; and the support bracket is guided along the guide rods.

12. The continuous variable valve duration apparatus of claim 11, wherein a shaft hole where the eccentric control shaft is inserted thereto is formed to the each cam cap.

13. An engine comprising:

a camshaft;

a first cam portion, a second cam portion, a third cam portion and a fourth cam portion of which a cam is formed thereto respectively, of which the camshaft is inserted thereto, of which relative phase angles with respect to the camshaft are variable, disposed on cylinders sequentially and the first, the second, the third and the fourth cam portions mounted to a cylinder head by cam caps;

a first inner bracket, a second inner bracket, a third inner bracket, and a fourth inner bracket transmitting rotation of the camshaft to the first, the second, the third and the fourth cam portions respectively;

a first slider housing of which the first and second inner brackets are rotatably inserted thereto and of which relative position with respect to the camshaft is variable;

a second slider housing of which the third and the fourth inner brackets are rotatably inserted thereto and of which relative position with respect to the camshaft is variable; and a support bracket connecting the first and second slider housings; and a control portion selectively changing the relative positions of the first and the second slider housings.

14. The engine of claim 13, wherein a first sliding hole and a second sliding hole are formed to the first, the second, the third and the fourth inner brackets respectively;

a slider pin connected with the camshaft is rotatably inserted into the first sliding hole;

a cam key is formed to the first, the second, the third and the fourth cam portions respectively; and a cam pin of which a cam key slot for the cam key to be slidably inserted thereto is formed thereto is slidably inserted into the second sliding hole.

15. The engine of claim 13, wherein the slider pin comprises:

a pin body connected to the camshaft; and a pin head slidably connected with the pin body and rotatably inserted into the first sliding hole.

16. The engine of claim 13, further comprising a double row bearing disposed within the first and the second slider housings respectively and connected with the first, the second, the third and the fourth inner brackets.

17. The engine of claim 13, wherein a control slot is formed to the first and second slider housings respectively, and the control portion comprises:

an eccentric control shaft inserted into the control slots;

a worm wheel connected to the eccentric control shaft;

a worm gear connected to the control motor and engaged with the worm wheel; and a control motor selectively driving the worm gear.

18. The engine of claim 13, wherein guide rods are connected to the cam cap respectively;

guide holes where the guide rod is inserted thereto respectively are formed to the support bracket; and the support bracket is guided along the guide rods.

19. The engine of claim 18, wherein a shaft hole where the eccentric control shaft is inserted thereto is formed to the each cam cap.

* * * * *